US006427563B1

(12) United States Patent
Zurbuchen et al.

(10) Patent No.: US 6,427,563 B1
(45) Date of Patent: Aug. 6, 2002

(54) INSULATING COMPOSITE HOLLOW SHAFT TOOL

(75) Inventors: Gregory A. Zurbuchen; Roger N. Wabalickis; David D. Curry, all of Kenosha, WI (US)

(73) Assignee: Snap-on Technologies, Inc., Lincolnshire, IL (US)

( * ) Notice: Subject to any disclaimer, the term of this patent is extended or adjusted under 35 U.S.C. 154(b) by 0 days.

(21) Appl. No.: 09/626,287

(22) Filed: Jul. 25, 2000

(51) Int. Cl.[7] ..... B25B 23/16
(52) U.S. Cl. ..... 81/177.1; 81/490; 81/900
(58) Field of Search ..... 81/177.1, 490, 81/900

(56) References Cited

U.S. PATENT DOCUMENTS

| | | | | |
|---|---|---|---|---|
| 2,899,996 A | | 8/1959 | Stockman | |
| 3,186,264 A | | 6/1965 | Barlow | |
| 3,878,740 A | * | 4/1975 | Gutshall | 81/124.6 |
| 4,202,101 A | | 5/1980 | Weissman | |
| 4,307,634 A | | 12/1981 | Gentry | |
| 4,417,488 A | | 11/1983 | Gentry | |
| 4,582,352 A | | 4/1986 | Filter et al. | |
| 4,858,504 A | | 8/1989 | Tsai | |
| D310,472 S | | 9/1990 | Mader et al. | |
| 4,970,921 A | | 11/1990 | Fagan | |
| 5,052,253 A | | 10/1991 | Lin | |
| 5,181,439 A | | 1/1993 | Schwartz | |
| 5,213,015 A | | 5/1993 | Disston, Jr. | |
| 5,259,277 A | * | 11/1993 | Zurbuchen | 81/900 X |
| 5,359,911 A | | 11/1994 | Kruesi | |
| D359,216 S | | 6/1995 | Kozak | |
| 5,628,556 A | | 5/1997 | Hrabar et al. | |
| 5,638,727 A | | 6/1997 | Gringer | |
| D397,599 S | | 9/1998 | Stamp | |
| 6,029,549 A | | 2/2000 | Baker | |
| 6,030,092 A | | 2/2000 | McCalla et al. | |
| 6,216,566 B1 | * | 4/2001 | Zurbuchen | 81/900 X |

* cited by examiner

*Primary Examiner*—James G. Smith
(74) *Attorney, Agent, or Firm*—Seyfarth Shaw

(57) ABSTRACT

There is illustrated an electrically insulating hand tool having a shaft that is hollow along its entire length, a work-engaging insert received in one end of the shaft, and an electrically insulating handle connected to an opposite end of the shaft. The shaft has a unitary one-piece construction and is made from a composite material.

17 Claims, 2 Drawing Sheets

INSULATING COMPOSITE HOLLOW SHAFT TOOL

BACKGROUND OF THE INVENTION

The subject matter of this application relates to hand tools of the type which are electrically insulating so that they can be safely used in applications where they may come into contact with sources of electrical power. More specifically, the subject of this application is an electrically insulating hand tool having an elongated shank with a handle connected thereto and a work engaging insert disposed in the shank.

There are currently a number of hand tools developed to be used on or around sources of electrical power. Such tools are typically formed of metal materials that have an insulated coating thereon or otherwise are covered with insulating materials. These tools are typically connected to handles with electrically insulating properties.

While these tools generally work to electrically isolate the user from electricity, there is always a present danger that the insulation on these tools will become damaged, thus compromising its ability to insulate the user from electricity. Consequently, there is a significant risk in using these insulated tools on or around electrical sources, and these tools are not generally recommended for use around or on components involving high voltages.

Currently, there are also tools being manufactured from plastic materials. These tools provide greater electrical insulating capabilities than the insulated tools, but they often lack the bending and/or torque strength of their metal counterparts. This limits the types of applications in which the plastic tools can be used, and it also affects the safety of the plastic tools.

SUMMARY OF THE INVENTION

Generally, the subject of this application is to provide an improved electrically insulated tool which avoids the disadvantages of the prior art while affording additional structural and operating advantages.

An important feature is the provision of an electrically insulating hand tool which is of relatively simple design and economical structure.

Another feature is the provision of an electrically insulating hand tool that provides greater safety when used on or around sources of electricity.

Another feature is the provision of an electrically insulating hand tool that is lightweight yet sturdy.

Another feature is the provision of an electrically insulating hand tool constructed from composite materials.

In connection with the foregoing features, yet another feature is the provision of a method of making an electrically insulating hand tool with the features stated above.

BRIEF DESCRIPTION OF THE DRAWINGS

For the purpose of facilitating an understanding of the subject matter sought to be protected, there is illustrated in the accompanying drawings an embodiment thereof, from an inspection of which, when considered in connection with the following description, the subject matter sought to be protected, its construction and operation, and many of its advantages should be readily understood and appreciated.

DETAILED DESCRIPTION

Figure 1:
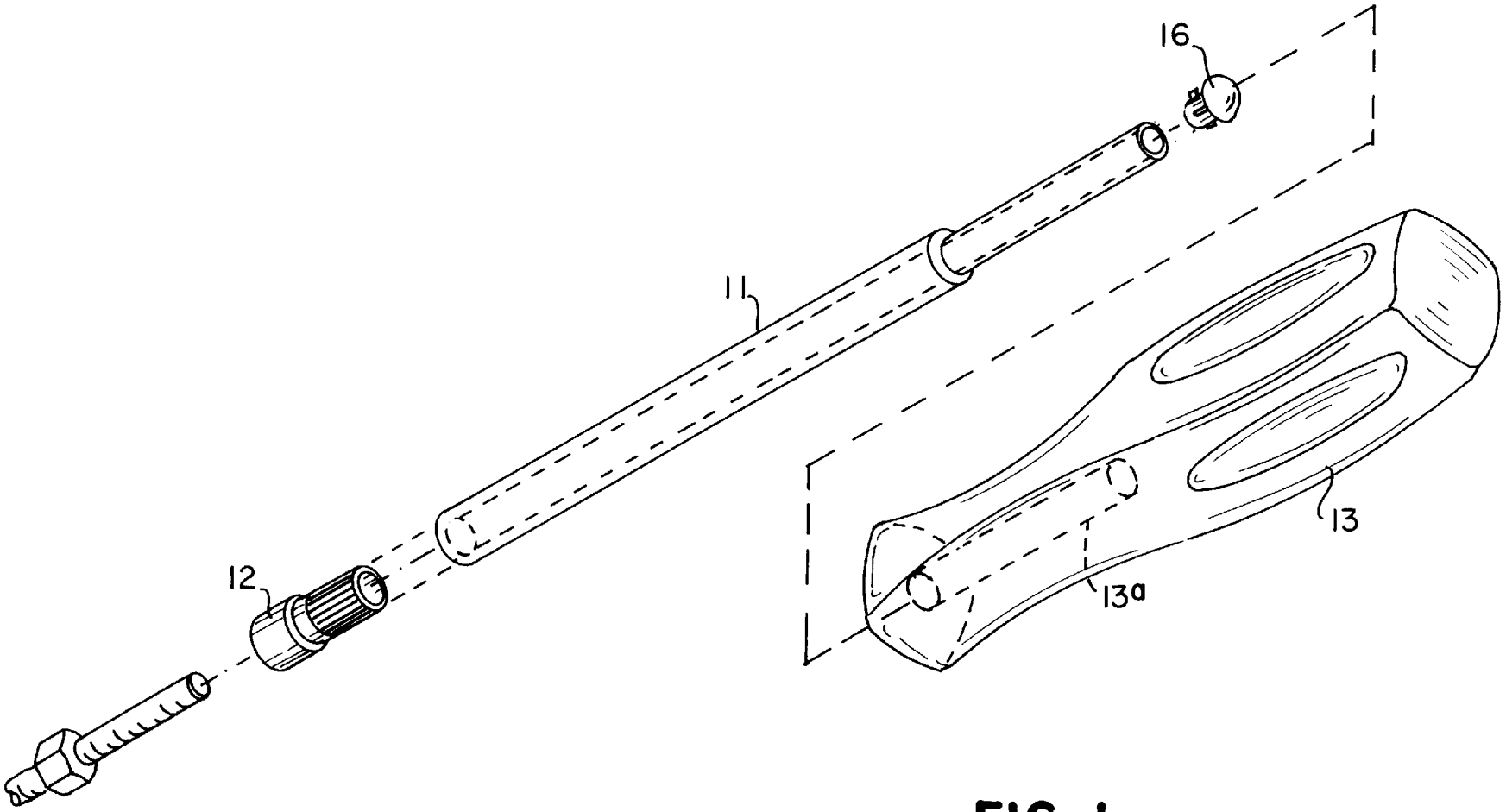
FIG. 1 is an exploded perspective view of an embodiment of the subject matter of this application of an associated fastener.
Figure 2:
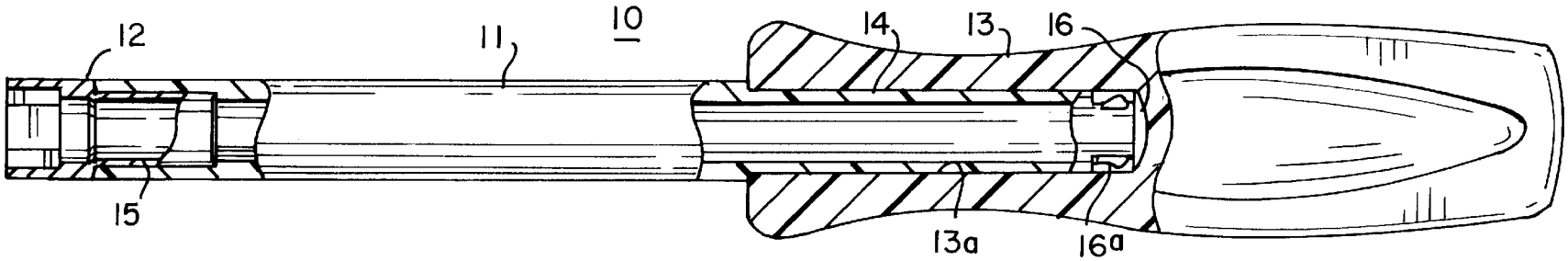
FIG. 2 is an enlarged side view of the embodiment in FIG. 1 with portions of the embodiment sectioned to reveal underlying structure.

Referring to FIGS. 1 and 2, there is illustrated an electrically insulating hand tool, generally designated by the numeral 10, constructed in accordance with the subject matter of this application. The hand tool 10 is comprised of a shaft 11 that is hollow along its entire length, a work-engaging insert 12 received in one end of the shaft 11, and an electrically insulating handle 13 connected to an opposite end of the shaft 11. For the purpose of illustration, the embodiment shown is configured as a nutdriver. However, it can be appreciated that the electrically insulating hand tool may be configured to perform a variety of different functions by simply changing the configuration of the work-engaging insert.

The shaft 11 is hollow along its entire length and formed of an electrically insulating, non-metallic, composite material. The use of a hollow, nonmetallic, composite material provides the hand tool 10 with torque and bending strengths akin to those of metal counterparts, while providing the hand tool 10 with significantly greater electrical insulating properties and reduced weight.

In one embodiment, the shaft 11 is of a unitary one-piece construction, constructed from a tubing made of a composite material including, alternating layers of braided glass fibers in an epoxy resin matrix. The shaft 11 is machined so that an end 14 of the shaft 11 has a smaller external diameter than the rest of the shaft 11, for insertion in an axial base 13a in the handle 13. The shaft is also machined so that an opposite end 15 of the shaft 11, in which the insert 12 is to be received, has an internal diameter greater than the rest of the shaft 11.

A cap 16 covers the end 14 opposite the insert 12. In this embodiment, the cap is made of a nylon material and has a shank portion 16*a* which is function fitted into the shaft 11.

Figure 4:
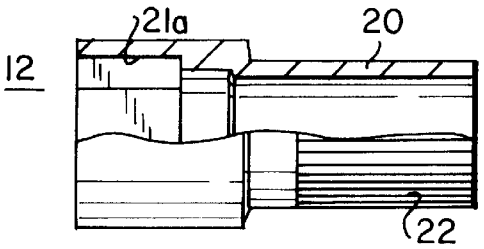
FIG. 4 is a side view of the insert in FIG. 3 with portions sectioned to reveal underlying structure.
Figure 3:
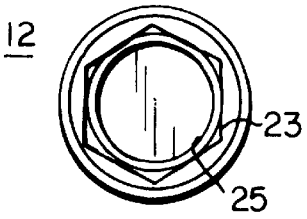
FIG. 3 is a further enlarged, and elevational overhead planar view of a work engaging insert shown in FIG. 1.
Figure 5:
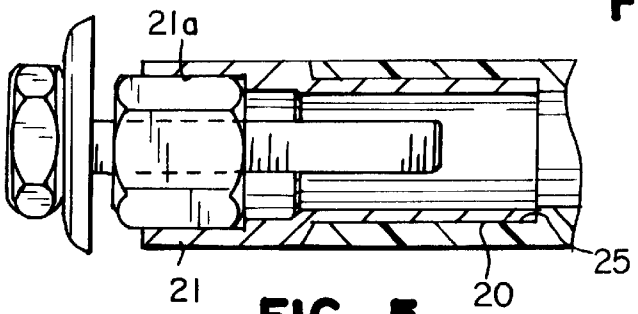
FIG. 5 is a further enlarged, fragmentary, sectional view of the left-hand end of the embodiment in FIG. 1 engaged with a bolt fastened onto a screw.

Referring to FIGS. 3, 4, 5, the work-engaging insert 12 may be formed of metal and features a mounting portion 20 and a work-engaging portion 21. In this embodiment, the work-engaging portion 21 defines a recess 21*a* which has a plurality of contact surfaces 23 located on its interior surface, enabling the insert 12 to engage a bolt or a nut, as shown in FIG. 5. It can be appreciated that, while this embodiment of the work-engaging portion 21 is configured to function as a nutdriver, the work-engaging portion 21 can be configured to perform a variety of other functions.

The mounting portion 20 is press-fitted into the shaft 11, and has a plurality of knurls 22 longitudinally extending along its exterior surface to inhibit relative rotation between the insert 12 and the shaft 11. A mounting portion 20 has an aperture 25 extending axially therethrough and communicating with the recess 21*a*. The aperture 25 allows a bolt to extend through the insert and into the shaft, enabling the electrically insulating tool to engage a nut which may be located about a lower portion of a longer shafted bolt.

The handle 13 is made of an electrically insulating material and is ergonomically designed to accommodate a user's hand. A bore 13*a* for receiving the shaft extends within the handle.

One method of constructing the electrically insulating hand tool involves machining a tubing made of a composite material so that one end has an external diameter sized for insertion into the bore, 3*a* in the handle 13, and machining the other end of the tubing so that its internal diameter is sized to receive the insert 12. A nylon cap 16 is then placed over the end of the shaft to be inserted into the handle. The tubing end with the cap 16 attached thereto is then adhesively secured within the bore 13*a* in the handle 13, the cap 16 serving to prevent adhesive from entering within the shaft. The insert 12 is then press fit into the end of the shaft opposite the handle 13.

The matter set forth in the foregoing description and accompanying drawings is offered by way of illustration only and not as a limitation. While a particular embodiment has been shown and described, it will be obvious to those skilled in the art that changes and modifications may be made without departing from the broader aspects of applicants' contribution. The actual scope of the protection sought is intended to be defined in the following claims when viewed in their proper perspective based on the prior art.

What is claimed is:

1. An electrically insulating tool comprising a shaft that is hollow along its entire length and formed of an electrically insulating non-metallic composite material, a work-engaging insert received in one end of the shaft and having a length substantially less than that of the shaft, an electrically insulating handle directly receiving therein an opposite end of the shaft and adhesively secured thereto, and a plug coupled to the shaft and closing the opposite end thereof.

2. The electrically insulating tool of claim 1, wherein the shaft is of unitary one-piece construction and made of a composite material including alternating layers of braided glass fibers in an epoxy resin matrix.

3. The electrically insulating tool of claim 2, wherein a hole extends axially through the insert.

4. The electrically insulating tool of claim 3, wherein the plug is formed of nylon and is received in the shaft.

5. The electrically insulating tool of claim 4, wherein the insert is press fit into the shaft.

6. The electrically insulating tool of claim 5, wherein a plurality of knurls extends along an exterior surface of the insert.

7. The electrically insulating tool of claim 6, wherein the end of the shaft receiving the insert has a greater inner diameter than the end received by the handle, and the end received by the handle has a smaller outer diameter than the end receiving the insert.

8. An electricaly insulating tool comprising a shaft that is hollow along its entire length to define an axial cavity and formed of an electrically insulating non-metallic composite material, a work-engaging insert received in one end of the shaft, the insert having an unobstructed hole extending axially therethrough and communicating with the cavity to permit an associated workpiece to be received through the hole and into the cavity, an electrically insulating handle receiving therein an opposite end of the shaft and adhesively secured thereto, and a plug coupled to the shaft and closing the opposite end thereof.

9. The electrically insulating tool of claim 8, wherein the shaft is of unitary one-piece construction and made of a composite material including alternating layers of braided glass fibers in an epoxy resin matrix.

10. The electrically insulating tool of claim 8, wherein the plug is formed of nylon and is received in the shaft.

11. The electrically insulating tool of claim 8, wherein a plurality of knurls extends along an exterior surface of the insert.

12. The electrically insulating tool of claim 8, wherein the end of the shaft receiving the insert has a greater inner diameter than the end received by the handle, and the end received by the handle has a smaller outer diameter than the end receiving the insert.

13. The electrically insulating tool of claim 8, wherein the insert is press fit into the shaft.

14. An electrically insulating tool comprising a tubular shaft of unitary one-piece construction made of a composite material including alternating layers of braided glass fibers in an epoxy resin matrix and defining an axial cavity, a work-engaging insert received in one end of the shaft and having a length substantially less than that of the shaft, an unobstructed hole extending axially through the insert and communicating with the cavity to permit an associated workpiece to be received through the hole and into the cavity, an electrically insulating handle directly receiving an opposite end of the shaft therein and adhesively secured thereto, and a plug coupled to the shaft and closing the opposite end thereof.

15. The electrically insulating tool of claim 14, wherein the plug is formed of nylon and is received in the shaft.

16. The electrically insulating tool of claim 14, wherein a plurality of knurls extends along an exterior surface of the insert.

17. The electrically insulating tool of claim 14, wherein the end of the shaft receiving the insert has a greater inner diameter than the end received by the handle, and the end received by the handle has a smaller outer diameter than the end receiving the insert.

* * * * *